United States Patent [19]

Koehler et al.

[11] 4,316,276

[45] Feb. 16, 1982

[54] KEY-OPERATED SOLID-STATE TIMEPIECES

[75] Inventors: Dale R. Koehler, Westwood; Jerrald A. Zupfer, River Vale, both of N.J.

[73] Assignee: Bulova Watch Company, Inc., Flushing, N.Y.

[21] Appl. No.: 497,758

[22] Filed: Aug. 15, 1974

[51] Int. Cl.[3] ..... G04C 17/00; G04C 9/00

[52] U.S. Cl. ..... 368/70; 368/188

[58] Field of Search ..... 58/4 A, 2, 3 R, 50 R, 58/85.5; 368/69, 70, 187, 188

[56] References Cited

U.S. PATENT DOCUMENTS

| | | | |
|---|---|---|---|
| 3,810,356 | 5/1974 | Fujita | 58/85.5 |
| 3,823,545 | 7/1974 | Vittoz | 58/85.5 |
| 3,823,551 | 7/1974 | Riehl | 58/50 R |

*Primary Examiner*—Vit W. Miska

*Attorney, Agent, or Firm*—Michael Ebert

[57] ABSTRACT

A solid-state electronic timepiece in which the output of a high-frequency time base is divided down to produce low-frequency timing pulses that are applied to a display actuator adapted to selectively control a multi-digit electro-optic display to present the "time-of-day" and "seconds" as well as other aspects of time information such as calendar date and month. The actuator also serves to supply roll-over pulses to advance the display at a rapid rate for setting purposes. In order to selectively render the display effective in any one of the several aspects or in the setting mode therefor by means of a singlmdmanually-operated coding key, a mode selector is provided which is responsive to the key and operates in conjunction with the display actuator. Code signals produced by the key are decoded by the logic system to produce command signals that are fed to the actuator to cause the display to operate in the aspect mode to present the desired aspect or to operate in the setting mode.

19 Claims, 4 Drawing Figures

Frequency Standard
10
Frequency Converter
11
Display Actuator
12
Control Signals
Mode Selector
14
Key
15
Clock Signal
Electro-Optic Display
S1
S2
C
S3
S4

FLOW CHART

KEY-OPERATED SOLID-STATE TIMEPIECES

BACKGROUND OF THE INVENTION

This invention relates generally to solid-state electronic timepieces having an electro-optic display capable of selectively presenting several aspects of time information, each of which is settable, and more particularly to an electronic logic system for a solid-state timepiece which is controlled by a manually-operated coding key and is adapted to effect a selection of a desired display aspect of the setting mode therefor.

The term solid-state electronic timepiece, as used herein, is limited to timepieces provided with an electro-optic time display and having no moving parts. The traditional, spring-powered mechanical watch produces rotary motion for driving gear works that operate the moving hands or time indicators. In those electronic watches which also have a moving hand read-out, the oscillations of a balance wheel or the vibrations of a tuning fork are electronically-sustained, those oscillations or vibrations being converted into rotary motion for driving the gear train. Hence moving parts are included in electronic timepieces of this type.

However, in recently-introduced types of solid-state electronic watches, electrical pulses derived from a crystal-controlled time base serve to actuate a multi-digit electro-optic display formed either by light-emitting diodes (LED) or by liquid-crystal display elements (LCD). Hence in such solid-state electronic timepieces, no moving parts are entailed. In such solid state watches, the high-frequency output of the time base is fed to a frequency converter constituted by a chain of integrated circuit divider stages. The output of the converter consisting of low-frequency timing pulses (i.e. 1 Hz), is applied to a display actuator in the form of a miniature time-computer module that counts the input pulse train, encodes it in binary form and then decodes and processes the results so as to provide the appropriate signals at the display stations.

In a battery-operated electronic watch having moving parts, such as that disclosed in U.S. Pat. No. 2,971,323, the time display is continuous, yet the efficiency of the movement is such that the operating life of the small power cell is well over a year. But in a solid-state watch, the power requirements of the electro-optic display in the case of an LED type of display, are relatively high; hence should the display be continuous, the life of the battery would be quite brief.

It is for this reason that commercially-available types of solid-state watches having an LED display are provided with a normally-quiescent display that is turned on only when the user depresses a push-button demand switch, thereby conserving power and prolonging the life of the battery. In one such watch, as disclosed in U.S. Pat. Nos. 3,756,013 and 3,759,031, the LED display is programmed so that upon merely touching the push-button switch, the minutes and hours are indicated for an interval of one and one-quarter seconds, whereas continued depression of the switch causes the minutes and hour data to fade and the seconds to appear and to continue to count as long as the button is held in.

In this solid-state timepiece, precise computation of time is continuous and independent of whether or not it is displayed, so that the moment the switch is depressed, timing signals are applied to the display. In solid-state watches of the type disclosed in U.S. Pat. Nos. 3,756,013 and 3,759,031, setting of the readings is accomplished by separate switches, one for "hours" and the other for "minutes". These setting switches are actuated by inserting a probe in a recess giving access thereto. When the "hours" set switch is operated, the "hours" read-out advances rapidly without disturbing the setting of the minutes and seconds. When the "minutes" setting switch is actuated, the "seconds" are automatically zeroed, while the minutes are advanced to the desired setting. In a similar electronic watch of this type as disclosed in U.S. Pat. No. 3,817,021, the setting switches are operated by means of external magnets to avoid sealing problems.

Hence, in a solid-state watch in which the time information exhibited on the electro-optic display has only two aspects (i.e., time-of-day and seconds), the minimum number of switches is three, in that by having a common switch or button to select either aspect of time information, it is still necessary to have two additional switches for the setting modes.

But when a four digit electro-optic time display also includes a read-out of calendar date, then additional switches are required. In a solid-state watch of this type, the read-out has three aspects, the first being "time-of-day" (hours and minutes), the second being "seconds" and the third being "calendar date"; each aspect being settable.

In order to reduce the number of switches required in a three-aspect display, it is now the practice in certain commercially available watches of this type, such as the Elgin "Minicon", to make use of two push-button switches which are so arranged that by pressing one button, the first aspect is presented, by pressing both buttons simultaneously, the second aspect is presented, and by pressing only the other button, the third aspect is seen. However, in addition to the two buttons, a setting switch is required, which switch when operated will advance the reading selected by the buttons.

Solid-state watches have been developed in which in addition to the previously mentioned aspects which appear in numerical form, the display is adapted to present data in an alphabetical format, such as the day of the week (Mon. to Sun.) or the name of the month (Jan. to Dec.). In this instance, the LED display elements are in nine-segment or in dot-matrix form capable of producing an alpha-numeric read-out. Here again, the number of switches required is determined by the number of display aspects.

The fact that in solid state watches the need for separate setting switches for each of the various readings unduly complicates the watch structure and makes it difficult for the user to carry out setting operations is recognized in U.S. Pat. No. 3,823,545. In this patent, selective setting is effected by a data input circuit which sequentially causes numbers to be displayed, each representing a reading to be corrected. Thus number "0" represents correction of the units of seconds, number "1" represents corrections of tens of seconds and number "2" represents corrections of units of minutes. When the numbers are presented, the user who wishes to correct a particular reading, presses a button to hold the appropriate number and to cause the reading selected thereby to advance. But in this arrangement, no means are provided to simplify the selection of the various time and calendar displays.

Thus in more sophisticated forms of solid-state watches, the switches or push-buttons entailed by the multiplicity of display aspects has reached a stage which, in practical terms, is approaching the unmanageable. The need for a multitude of aspect and setting switches all housed in a small casing, creates serious problems. Not only is it necessary to place these switches at accessible yet distinct positions on the casing, but it is also essential that each switch position be water proofed. And quite apart from these factors is the matter of human engineering and dexterity, for the average user, faced with a scattering of buttons and switches, finds it difficult to remember which button or switch serves what purpose, to say nothing of the problem of manipulating an individual button which is in close proximity to another button that is not to be pressed at the same time.

SUMMARY OF THE INVENTION

In view of the foregoing, it is the main object of this invention to provide a mode-selecting electronic logic system for a solid-state timepiece, the mode selector being operated by a single coding key and serving to selectively actuate the electrooptic display in the aspect mode to present any one of several aspects of time information or to render the display operative in the setting mode.

More particularly, it is an object of this invention to provide a mode selector of the above-described type wherein the user, by operating the single coding key in accordance with a predetermined code that is easily acquired, is able to produce a desired aspect of time information, or to render the display operative to set any of the several readings.

The nature of the code units (i.e., all dots, or dots and dashes) and the number of units in the code depends on how many commands or addresses are required by the timepiece display, so that for a time display having say three aspects and a setting mode, a simpler code may be used than one dictated by a display having five aspects and a setting mode. But in no event is this code complex, so that no difficulty is experienced by the user, however unskilled, in mastering the appropriate code.

A significant advantage of the invention lies in the reduced cost of manufacturing the timepiece, for the invention dispenses with the need for a multitude of mechanically-operated switches and special casings to accommodate these switches. More over while the invention replaces these switches with a single switch or key associated with a mode selector, the selector may be in a highly compact and relatively inexpensive integrated circuit form.

Briefly stated, these objects are attained in a solid-state timepiece including a high-frequency time-base or frequency standard whose output is supplied to a converter in the form of a multi-stage frequency divider yielding low-frequency timing pulses that are applied to a display actuator. The display actuator is in the form of a logic circuit that is adapted to control a multi-digit electro-optic display which selectively presents time-of-day and seconds information as well as other aspects of time information such as calendar date and month. The actuator is also adapted to supply roll-over pulses to a selected reading to advance the reading at a rapid rate for setting purposes.

In order to selectively render the electro-optic display effective in any one of the several aspects in the aspect mode or in the setting mode therefor, an electronic logic system or mode selector is provided which operates in conjunction with the display actuator and includes a manually-operated coding key. The code signals produced by the key are decoded by the mode selector to produce command signals which in the aspect mode are applied to the actuator to cause the display to present a desired aspect or to operate in the setting mode. In the setting mode, the logic system acts to step the display to present the various readings in sequence, a desired reading being selected by holding down the key, at which point the reading is advanced rapidly.

OUTLINE OF THE DRAWINGS

Figure 4:
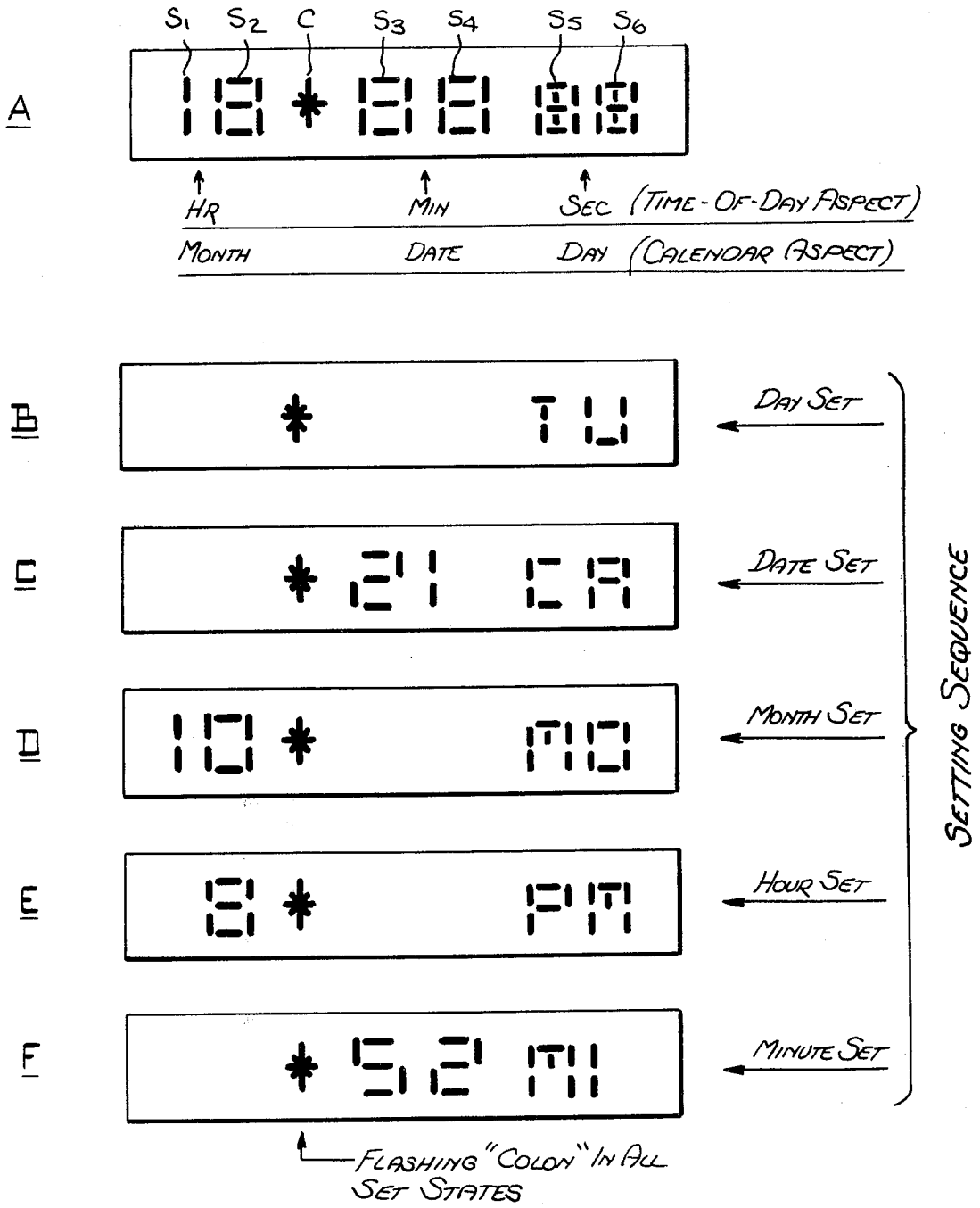

FIGS. 4A to F illustrate a six digit LCD display which is operated by a mode selector in accordance with the invention, FIG. 4A showing the aspect mode and FIGS. B to F showing different settings in the setting mode.

DESCRIPTION OF THE INVENTION

THE ELECTRONIC WATCH

Figure 1:
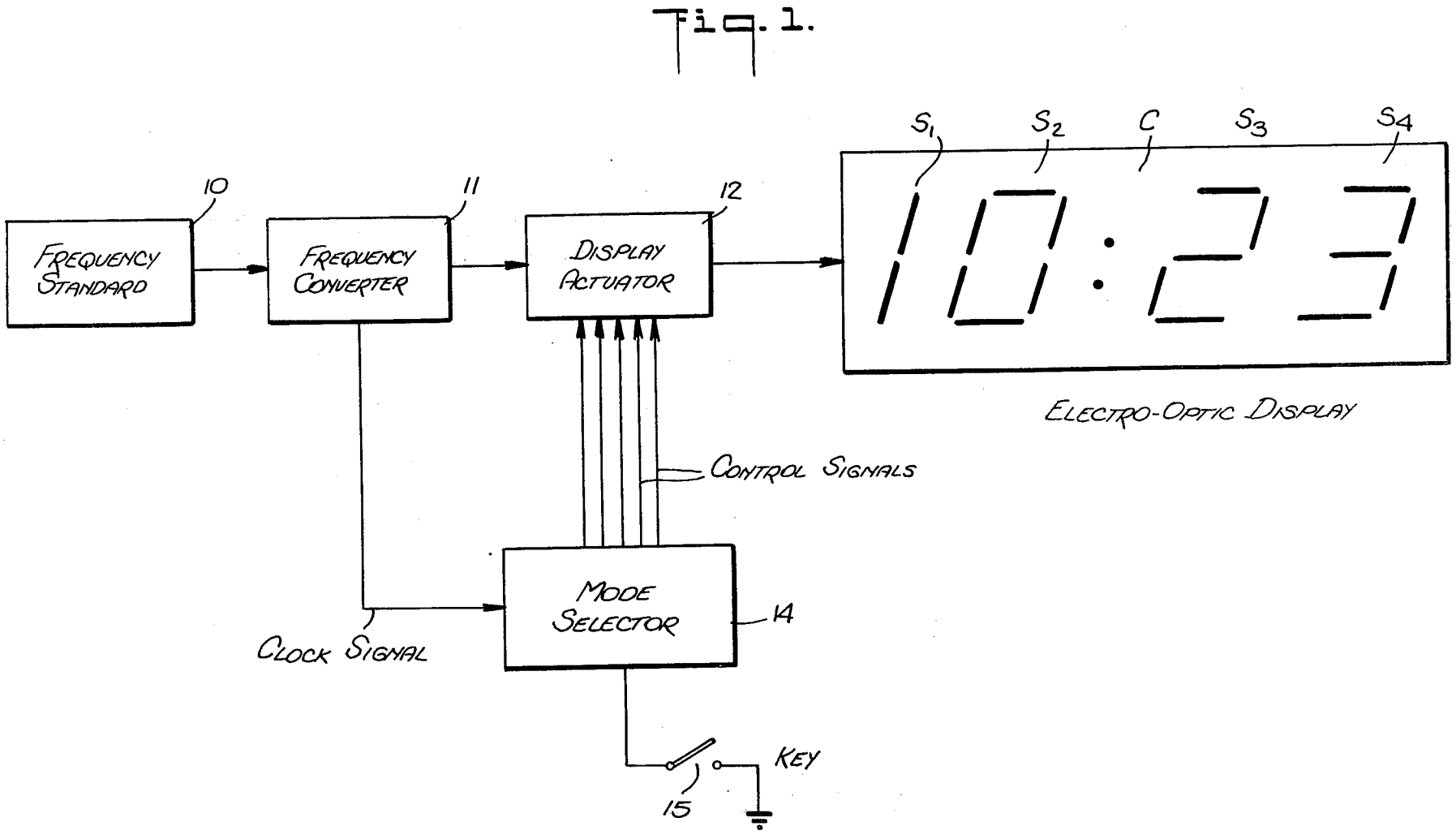
FIG. 1 is a block diagram of a solid-state electronic timepiece having an LED display and including a mode selector in accordance with the invention.

Referring now to FIG. 1, there is shown in simplified form, a block diagram of the main components of a key-operated, solid-state timepiece in accordance with the invention. The time-piece includes a time base or frequency standard 10, preferably in the form of a crystal-controlled oscillator having a high-frequency output (i.e. 32,768 Hz). This output is fed to a frequency converter 11 that divides down the standard frequency to produce low-frequency timing pulses at a constant rate (i.e. 1 Hz).

These timing pulses are applied to a display actuator 12 which in turn drives an electro-optic display 13 which, in FIG. 1, shows the time-of-day. The display to be first described is of the LED type. It is to be understood however, that the display may be in any other electro-optic form, such as an LCD or electro-luminescent display. The frequency converter and the display actuator preferably are in integrated circuit form, use being made of complementary MOS circuits to effectively produce a miniaturized, fixed-program computer having low power requirements.

By way of example only, the timepiece disclosed herein is one capable of presenting the following aspects of time information.

| | |
|---|---|
| I | Time-Of-Day (Hours and Minutes). |
| II | Seconds. |
| III | Calendar Month and Date, both expressed numerically. |

For this purpose, display 13 has four digital stations $S_1$, $S_2$, $S_3$ and $S_4$, a colon C being inserted between the second and third stations. Each display station may be constituted by a 7-bar segment array of light-emitting diodes, such as those formed from gallium arsenide phosphide which produce light in the visible red region. By selective actuation of the segments, one may present the digits 0 to 9. Colon C is defined by a pair of light-emitting diodes.

Thus "time-of-day" is presented by activating all four digits $S_1$ to $S_4$ to give an "hour" and "minutes" reading, say 10:25. Seconds are presented by using only digits $S_3$ and $S_4$ to produce the numbers 00 to 59. A month and calendar date reading is produced by using digits $S_1$ and $S_2$ for the months 1 to 12 and digits $S_3$ and $S_4$ for the dates 1 to 31.

In known types of solid-state watches for presenting aspects I, II and III, the display actuator operates in conjunction with mechanical switches which, when closed, energize the appropriate display aspect. Additional mechanical switches are provided for setting the various readings. In the present invention, all of the mechanical switches in the actuator are replaced by electronic gates or switching circuits which are activated by command signals generated by a mode selector 14 in response to code signals derived from a single manually-operated coding key. Thus the casing of the watch need carry only a single push-button switch or key to be manipulated by the user in keeping with a predetermined code.

When therefore the user momentarily presses key 15 to produce a single "dot", time-of-day is presented by the display, but when the user presses key 15 for a longer period to produce a single "dash", the presentation is of seconds. And if the key is pressed to produce two dots in succession, then one sees the month and date. But before analyzing the character of a code considered to be mode practical for a watch having three aspects of time information as well as a setting mode, we shall first review briefly the range of permutations possible with a simple three-unit code comprising dots and dashes as shown in Table A below:

TABLE A

| | | | |
|---|---|---|---|
| 1. | . | | |
| 2. | — | | |
| 3. | . | . | |
| 4. | . | — | |
| 5. | — | . | |
| 6. | — | — | |
| 7. | . | . | . |
| 8. | . | . | — |
| 9. | . | — | . |
| 10. | . | — | — |
| 11. | — | . | . |
| 12. | — | . | — |
| 13. | — | — | . |
| 14. | — | — | — |

It will be seen from Table A that with a three-unit code in which the units of the code are dots, dashes and combinations of dots and dashes, that the maximum number of distinct code signals which can be derived is fourteen. Again it must be noted that a dot is produced by closing the key switch for a short period and a dash by closing the key for a longer period. The Morse code for telegraphy which has a distinct signal for each letter in the alphabet is a four place code.

Since a three-unit code having fourteen distinct values is more than is required for the selective operation of a watch having three or four aspects of time information plus a setting mode, let us now consider the permutations possible with a still simpler, two unit dot-dash code, as shown in Table B below:

TABLE B

| | | |
|---|---|---|
| 1. | . | |
| 2. | — | |
| 3. | . | . |
| 4. | . | — |
| 5. | — | . |
| 6. | — | — |

Here with a two-unit code, one has available six distinct signals, but this too is more than is actually necessary. Moreover it is fairly difficult to memorize such a code, for one can readily confuse dot-dash and dash-dot or dot-dot and dash-dash. It is possible with a code composed entirely of dots to produce five signal states, which is adequate for a three aspect display and a setting mode, plus a display blanked state as shown in Table C below:

TABLE C

| | | | | | |
|---|---|---|---|---|---|
| Time-Of-Day | . | | | | |
| Month and Day | . | . | | | |
| Seconds | . | . | . | | |
| Setting Mode | . | . | . | . | |
| Display Blanked | . | . | . | . | . |

The possible objection to the Table C code is that it fails to exploit the possibility of holding the key down longer to convert a dot to a dash and thereby have a reading transfer automatically from one aspect to another. A three-unit code which includes a dash and is extremely easy to memorize is shown in Table D below:

TABLE D

| | | | |
|---|---|---|---|
| Time-Of-Day | . | | |
| Month and Day | . | . | |
| Second | — | | |
| Setting Mode | . | . | . |
| Display Blanked | . | . | — |

In the electronic system to be described in connection with FIG. 2, use is made of the code contained in Table D. It is to be understood however that the invention is by no means limited to a three-aspect display plus setting mode watch for which this code is expressly devised, nor is the invention confined to this particular code for this watch, in that many other code combinations for the same purpose are possible. The essence of the present invention resides in carrying out a multiplicity of switching functions by means of a single coding key each of whose code signals is decoded by a logic system tailored to whatever code is in use to produce a command signal for effecting a respective switching function.

Figure 2:
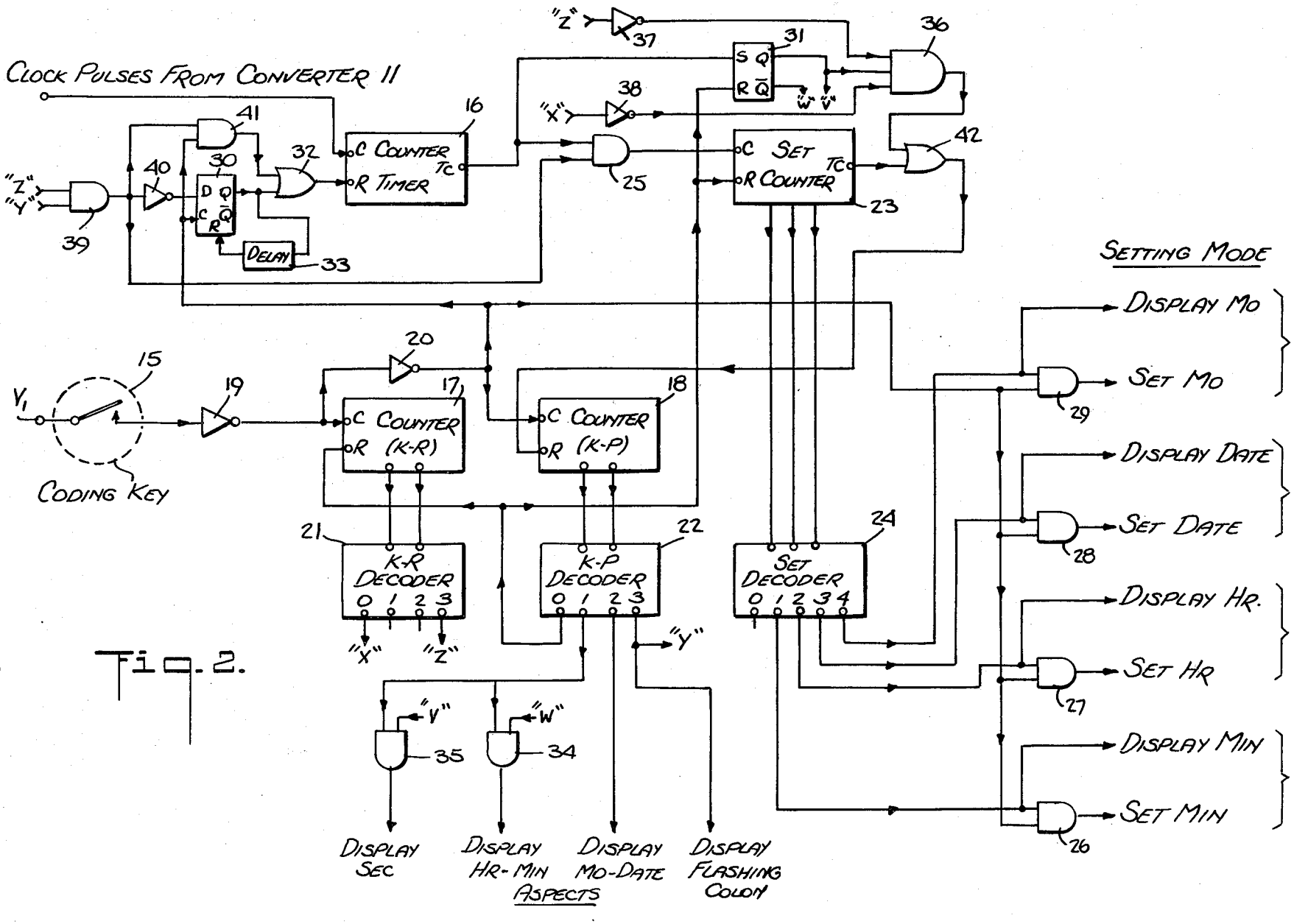
FIG. 2 is a block diagram of the mode selector system.

BEHAVIOR OF ELECTRONIC LOGIC SYSTEM (MODE SELECTOR):

Referring now to FIG. 2, there is shown a preferred embodiment of an electronic logic system adapted to decode code signals produced by key 15 to produce command signals which are applied to display actuator 12 for effecting a selective presentation on the four-digit electro-optic display 13 of the LED type of three aspects of time information: time-of-day, seconds and calendar month and date, and for producing a command signal for rendering the display operative in the setting mode.

The system is arranged to respond to dot and dash code signals in the three unit code set forth in Table D. Key 15 producing the code signals may be in any suitable form, such as a push-button or any other type of normally-open switch which when held down, pushed, pressed in or shifted from its normal position, closes to apply a voltage representing the binary value "1" to the logic system, the key when released applying a binary value "0" thereto. The code unit produced by operation of key 15 depends on how long it is held down, for when the hold-down period is less than a predetermined time interval designated as T, the resultant signal is a dot, and when the hold-down period exceeds interval T the code signal is a dash.

The logic system entails a certain time interval to distinguish a dot from a dash or two dots from one dot; hence the arrangement is such as to make it possible for the electro-optic display to function and to sequence as the key is being operated. For example, if the user presses in the key and holds it down to produce a dash to bring on a "seconds" display, the moment the key is pressed, the display presents "time-of-day", as if a "dot" had been intended. But after a time interval T with the key still held down, the system senses a dash and automatically switches over to produce the "seconds" display.

Similarly, if the user manipulates the key to produce two dots in succession, the system in response to the first dot brings on a "time-of-day" display and then when the second dot is decoded, switches over to the calendar "month and date" display.

In the setting mode effected by keying in three dots in succession, the colon is caused to flash as soon as these dots are decoded to provide a visual indication to the user that the watch is now operative in this mode. After time interval T, the display in the setting mode proceeds to automatically step through a setting cycle in which the display first presents "minutes", then "hours", after which the calendar data appears, followed by the month. Each reading state in the setting cycle lasts for a time period T (i.e.-one second).

When during this automatic stepping action from reading to reading in the setting mode, the key is pressed, the reading then in effect will be maintained as long as the key is held in, and the read-out will proceed to advance at a "roll-over" rate. By roll-over rate is meant a rate of advance much faster than the normal timing rate for the reading being set. Thus in the case of a "minutes" reading, the minutes will advance say every half second, and in the case of an "hours" reading, the hours will advance every second. And when the proper number appears on the display and the key is immediately released, roll-over will be arrested and the normal time rate resumed. Each reading of the timepiece may therefore be separately set.

When automatic stepping in the setting mode has completed a full cycle running through "minutes", "hours", "date" and "months", the display is blanked and the circuit returns to its idle state. By again operating the key to produce a succession of three dots, a new setting cycle is initiated.

Thus to summarize the operation of the electronic logic system in response to signals produced by the coding key, the arrangement is such that when a single dot is decoded, the time-of-day is exhibited on the four-digit display, when two dots in succession are decoded, the exhibit is of calendar month and date, and when a dash is produced, seconds are seen. The watch is set by keying in three dots in succession to initiate a stepping action. When a particular reading to be set appears, the key is pressed in and held until the reading locked in by this action has advanced to the proper number, at which point the key is released. To blank the display, one keys two dots and a dash in succession.

Figure 3:
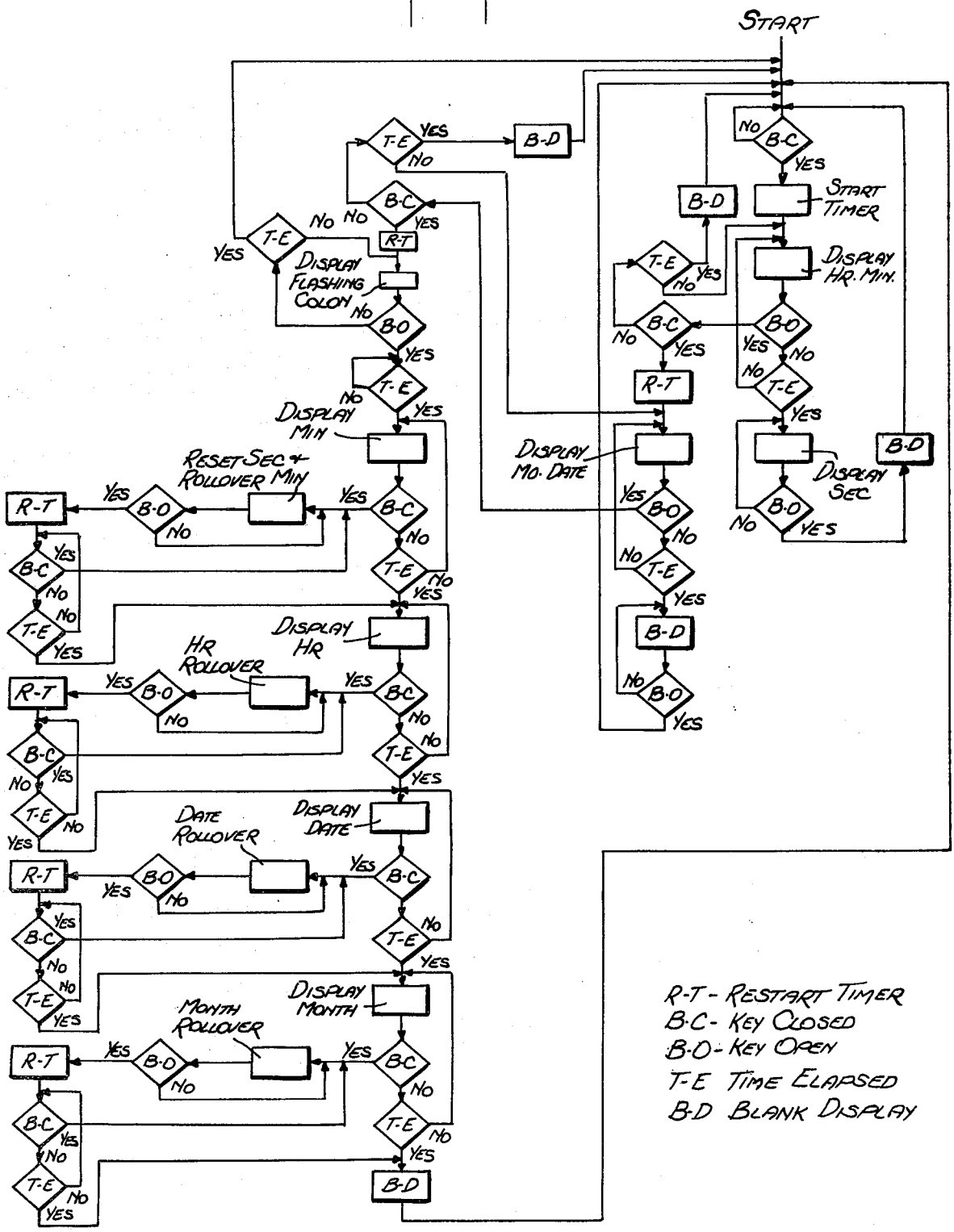
FIG. 3 is a flow chart indicating how the mode selector behaves.

The exact behavior of the electronic logic in response to code signals in all possible situations within the constraints of the system is set forth in the flow chart in FIG. 3. The symbols in this figure take the form of rectangles and diamonds, the rectangles standing for operations and the diamonds for decisions. Each rectangle contains an abbreviated statement of the operation performed by the logic system in response to code signals, such as "Mo-Date Display" and "Display Hr". The diamonds, on the other hand, contain an abbreviated statement concerning the decision (Yes or No) made by the circuit when the coding key or button is closed or open, and time interval T either has or has not elapsed.

CIRCUIT OF ELECTRONIC LOGIC SYSTEM (MODE SELECTOR):

As shown in FIG. 2, the circuit of electronic logic system 14 includes a timer 16 which is a resettable counter adapted to produce at its output terminal TC one or more pulses that are spaced "T" time units apart. In practice, the unit of time T may have a duration from about 1 to 2 seconds. Clock signals at a constant rate are applied to input terminal C of timer 16, these signals being derived from an intermediate stage in the divider chain in frequency converter 11. Since the output stage of this divider, in the embodiment disclosed herein, produces one pulse per second, one may obtain from an intermediate stage four or eight pulses per second, depending on where the chain is tapped. Timer 16 is reset by applying a reset signal to reset terminal R.

The precision of the time elapsed from the instant of resetting of timer 16 to the issuance of a first output pulse at terminal TC is determined by the repetition rate of the clock signal. Normally a 4 Hz or 8 Hz clock signal is used, giving an accuracy of 0.25 sec. or 0.125 sec., respectively.

Timer 16 has two functions, the first of which is to control the length of time the display is energized, the second of which is to establish the time interval T used to decode a "dot" from a "dash" or two dots from one dot, etc.

A dot is formed when key 15 is closed for a period less than interval T, and a dash when it is closed for a period longer than interval T. In order to record the number of times key 15 is pushed or pressed in and the number of times it is released after being pressed in, two counters are provided. Counter 17 acts as the key-released (K-R) counter, while counter 18 serves as the key pushed-in (K-P) counter.

K-R counter 17 has its count input terminal C connected to key 15 through an inverter 19. Since key 15 produces a binary value "1" when pressed-in, this counter through the inverter receives a binary value "0" and does not respond. But when key 15 is released, K-R counter 17 then sees a binary "1" through inverter 19 and responds.

K-P counter 18 has its input count terminal C connected through a second inverter 20 in series with first inverter 19 to key 15; hence when the key is pressed in, the K-P counter sees a binary value "1" and responds thereto. Thus each key action produces an opposite effect on the K-P and K-R counters. The K-P and K-R counters are of the "dead-end" type, which is to say that when they attain their maximum count (which in the example shown is 3), subsequent impulses have no effect thereon.

Associated with K-R counter 17 is a decoder 21, and similarly associated with K-P counter 18 is a decoder 22, each decoder having four distinct outputs 0, 1, 2 and 3. Thus when no count is entered in either counter, an output (binary value "1") appears only at output "0"

thereof, but when a single count is entered, the output signal is established at output "1", and so on. These decoders therefore generate a single "true" output for each state of the corresponding counter.

Also provided is a set counter 23 with which a decoder 24 is associated, the set counter having outputs 0, 1, 2, 3 and 4. The set counter components are operative in the setting mode of the system. The input count terminal C of set counter 23 is connected through an AND gate 25 to output terminal TC of timer 16, so that set counter 23 acts to register the number of time intervals T generated by the timer, while its decoder 24 furnishes outputs serving to bring about a display for setting purposes.

The output "0" of set counter decoder 24 is unused, whereas the other outputs carry out setting functions. Output "1" of decoder 24, when true, yields a command signal to cause the associated display actuator to present a "minutes" reading, this output being also applied to AND gate 26 which when enabled produces a command signal to cause the "minutes" reading to roll-over for setting purposes. Similarly, output "2" serves to produce an "hours" reading and in conjunction with AND gate 27 to cause this reading to roll over. Output "3" serves to produce a "date" reading and in conjunction with AND gate 28 to cause this reading to roll-over, while output "4" of decoder 24 serves to provide a "month" reading and in conjunction with AND gate 29 to cause this reading to roll-over.

Resetting of timer 16 is effected by means including flip-flop 30, while resetting of the counters is effected by means including flip-flop 31. Also provided are other gates, to be later identified, for operating in conjunction with the flip-flops and gates for carrying out other switching functions to be later described. We shall now explain how the system functions in response to code signals to select the various aspects of time information or render the display operative in the setting mode.

Time-of-Day Display

To explain the operation of the timepiece, we shall at the outset assume that K-P counter 18 has been reset, thereby causing output "0" of its decoder 22 to go true so that binary value "1" is now applied to reset terminal R of K-R counter 17 and to reset terminal R of set counter 23 as well as to reset terminal R of flip-flop 31 whereby these components are all maintained in the reset state.

Then when key 15 is pressed-in, K-P counter 18 is advanced one count by the code signal applied to its input count terminal C, the same signal being applied to the terminal C of flip-flop 30. As a result, flip-flop 30 produces a signal at its Q terminal that is applied through an OR gate 32 to reset terminal R of timer 16, thereby resetting the timer. The Q terminal of flip-flop 30 is also connected through a delay network 33 to reset terminal R of the flip-flop whereby this flip-flop is reset after an interval determined by the delay introduced by this network.

The output "1" of K-P decoder 22 is connected to one input of an AND gate 34 which when enabled, produces a command signal causing the display actuator to operate the display to provide a time-of-day presentation. The other input of AND gate 34 is connected through line W to terminal $\overline{Q}$ of flip-flop 31. Because the closing of key 15 causes K-P counter 18 to register one count, there is no longer an output yielded at output "0" of decoder 22, thereby removing the reset signal from K-R counter 17, set counter 23 and flip-flop 31. But since there is now an output (binary "1") at output "1" of decoder 22, this enables AND gate 34, causing the watch to display the time-of-day or hours and minutes.

The Seconds Display:

It is to be noted that the output "1" of decoder 22 is also connected to one input of an AND gate 35 whose other input "V" is connected to the Q terminal of flip-flop 31. AND gate 35 controls the "seconds" presentation.

Output terminal TC of timer 16 is connected to the set terminal S of flip-flop 31. If therefore key 15 which when closed, causes a command signal to be produced through AND Gate 34 to cause a time-of-day display, remains closed for at least one time interval T (dash), then the resultant output from timer 16 will be applied to the set terminal of flip-flop 31, producing a binary "1" at terminal Q and a binary "0" at terminal $\overline{Q}$, thereby enabling gate 35 to bring on the "seconds" display and disabling gate 35 to cut off the "time-of-day" display.

The setting action of flip-flop 31 does not produce an output from an AND gate 36, one of whose inputs is connected to the terminal Q of this flip-flop. It will be seen that a second input of AND gate 36 is connected via an inverter 37 and line Z to output "3" of K-R decoder 21, and that a third input of AND gate 36 is connected by an inverter 38 and line X to output "0" of K-R decoder 21. Because the "0" output of K-R decoder 21 is true, and this output is inverted by inverter 38, AND gate 36 is thereby disabled. Hence the watch will continue to display "seconds" as long as key 15 is held in. But upon release of the key, K-R counter 17 advances one count, which reverses the state of the output "0" of K-R decoder 21, thereby enabling AND gate 36 whose output is applied through OR gate 42 to reset terminal R of K-P counter 18, thereby resetting this counter which, in turn, resets the logic circuit to its idle condition.

If however key 15 is released before timer 16 produces an output at terminal TC, then AND gate 34 is disabled after time interval T. Assuming therefore that interval T is one second, and that the key was pressed-in to produce a single dot, then the result of this action is a time-of-day display lasting one second. The release of key 15 advances the K-R counter 17 which now allows AND gate 36 to reset K-P counter 18 when it receives an input from flip-flop 31 which will have been set by the timer.

Month-Date Display

Pushing in key 15, releasing it and pushing it in again will bring about a "month-date display for time interval T. With the second push action, timer 16 is reset by flip-flop 30 and K-P counter 18 is then at count "2". Hence output "2" of K-P decoder 22 is now true, producing a command signal causing the display to present the month and date (i.e. 09:31). At the conclusion of time interval T, timer 16 produces an output at terminal TC which is applied to terminal S of flip-flop 31 to set this flip-flop. This produces a signal at terminal Q of flip-flop 31, which signal is sent through enabled AND gate 36 and OR gate 42 to reset K-P counter 18 to zero.

As a consequence, K-P decoder 22 produces binary "1" at its output "0" which acts to reset K-R counter 17 as well as set counter 23 and flip-flop 31. Thus the system is again in its idle or quiescent condition. It is to be noted that whether or not the key which to produce the Month-Date reading has to be pushed-in, released and pushed-in again, is thereafter released a second time, this has no effect on the operation of the system once it has started displaying the Month-Date reading.

Setting Mode

Pushing in the key three times acts to render the system operative in the setting mode. When the key is pushed in the third time, timer 16 is again reset and K-P counter 18 is then at count 3, while K-R counter 17 is at count 2. The K-P decoder 22 which is true at output "3", produces a command signal activating the flashing colon circuit in the display actuator.

If key 15 is not released before time interval T has elapsed, the timer output will then set flip-flop 31, which enables AND gate 36, causing K-P counter 18 to reset through OR gate 42. The system is now back to its idle condition. Releasing the button before time interval T has run its course, holds the system in the setting mode.

The third release of key 15 places three counts in K-R counter 17, which in turn produces a binary "1" in output 3 of K-R decoder 21. This output, through line Z and inverter 37 acts to disable AND gate 36.

It will be seen that line Z is also connected to one input of an AND gate 39 whose other input is connected through line Y to output "3" of K-P decoder 22. Thus with a key signal of three dots, a true output is produced at outputs "3" of both K-R decoder 21 and K-P decoder 23 to enable gate 39 so that the watch system can now be set.

With AND gate 39 enabled, an output is applied through inverter 40 to the terminal D of flip-flop 30 as well as to one input of an AND gate 41 and AND gate 25. The pulses from output terminal TC of timer 16 passing through enabled AND gate 25 now act to advance set counter 23 at a rate of one advance per time interval T. As a result, set counter decoder 24 produces true outputs successively at its "1", "2", "3" and "4" output terminals. The resultant command signals provide a presentation stepping sequentially from readings of "minutes", "hours", "date" and "month", each step lasting a period equal to interval T.

If now key 15 is pressed-in while the stepping action is taking place, this permits setting of the reading being displayed at the instant the key is closed. Holding in the key will hold timer 16 in its reset state. The resultant signal is passed through the previously-enabled AND gate 41 and applied to reset terminal of timer 16. Now no output is yielded by timer 16 and the set counter 23 no longer advances. One of the AND gates 26 to 29 will go true, depending on the state of the set counter 23 as reflected in set-counter decoder 24 whose outputs are respectively connected to one input of the gates. The other input of gates 26 to 29 is connected to key 15 through inverter 20 and 19. The enabled AND gate (26 to 29) produces a command signal which causes the associated display actuator to feed roll-over pulses to the selected reading for setting purposes.

Upon release of the key, the setting signal is inhibited by disabling the previously-enabled setting signal AND gate. This also allows timer 16 to resume operation. If for some reason the display is not properly set to its desired reading, and if the key is again held in before time interval T has elapsed, the setting operation will be repeated.

Allowing the key to be released for a period equal to at least one time interval T will produce an output from the timer 16 that will permit set counter 23 to advance another step. If now the key is again held in, another reading may be set. This can be repeated until the set counter is filled, which means that the system has stepped through a complete setting cycle. When the set counter has reached its terminal count (4) which appears at its output terminal TC, it applies an output pulse through OR gate 42 to reset terminal R of K-P counter 18 to reset this counter, so that the system again reverts to its idle condition. If the watch is still not set correctly, then the sequence may be repeated by again keying to produce three dots.

LCD SOLID-STATE WATCH

In the embodiment of a solid-state watch previously described, the display is of the LED type. Hence in order to conserve battery power, the display must be in the normally "off" condition, the display being turned on by operating the key to produce code signals causing the mode selector to provide a desired aspect of time information or to switch the display into the setting mode.

But with a solid-state watch having an LCD display such as that disclosed in U.S. Pat. No. 3,820,108 and patents cited therein, power consumption is much lower and one may maintain the display in continuous operation to provide time-of-day information. However if the same LCD display is also to be used to selectively display other aspects of time information and possibly other forms of intelligence as well as to operate in the setting mode, one is again faced with mechanical switching problems. The present invention is effective in solving these problems.

Moreover as will become evident hereinafter, the present invention makes possible a highly sophisticated LCD display affording alpha-numeric information which avoids the confusion sometimes encountered when all displayed information is purely in numerical form. For example, if the day of the week is expressed numerically, so that Monday is "2" and Tuesday is "3", these numbers may be mixed up by the viewer with numbers representing the hours or minutes and numbers representing the month.

Referring now to FIG. 4A, there is shown a six-digit LCD display whose first digit $S_1$ is in two-segment form to represent only the number 1, no other number being required at this station. The second, third and fourth digits $S_2$, $S_3$ and $S_4$ are in seven-segment form so that by selective activation of these segments, one may create the numerals 0 to 9. Between the second and third digits is a colon C which is continuously activated in the aspect mode and is caused to flash intermittently in the setting mode (FIGS. 4B to F), so that the distinction between these modes is clearly indicated.

The fifth and sixth digits $S_5$ and $S_6$ are in nine-segment form so that these are capable, by selective activation, not only of producing the numerals 0 to 9 but also the letters of the alphabet. Thus digit $S_5$ may display a seven or the letter A.

The six-digit LCD display in this embodiment provides two aspects of time information; namely, a time-of-day aspect and a calendar aspect giving the month, date and day. In the time-of-day aspect, the first two digits $S_1$ and $S_2$ give the hour (1 to 12). The second two digits $S_3$ and $S_4$ give the minutes (00 to 59), and the last two digits $S_5$ and $S_6$ give the seconds (00 to 59). In the calendar aspect, the first two digits $S_1$ and $S_2$ give the month (1 to 12), the second two digits $S_3$ and $S_4$ give the date (1 to 31), and the last two digits $S_5$ and $S_6$ give the days of the week, the latter being indicated by letters SU, MO, TU, WE, TH, FR and SA.

Since the time-of-day aspect is normally "on" in an LCD watch, it is only necessary, in order to show the calendar aspect, to press the key to produce say a dot (or whatever other code signal is devised for this purpose) to transfer from the time-of-day to the calendar aspect. Hence the only other requisite keying actions are those required to switch into the setting mode and to operate within this mode.

In the setting mode disclosed in connection with FIG. 2 for an LED watch, the cycle sequence is from "minutes" to "hours" to "date" and finally to "month". In the LCD system which may employ essentially the same logic circuits for the mode selector, the setting mode arrangement is made such as to scan the readings beginning with the day of the week and then going sequentially through "date", "month", "hour" and "minutes".

As in the case of setting an LED watch, the code assigned to the LCD setting function may be three dots, such that when these dots are keyed in, the display is operative in the setting mode and the readings then proceed to sequence through the above-noted cycle. If one wishes to set a particular reading such as the calendar date, the key is pressed in when that reading appears, at which point the "date" proceeds to advance at a rapid rate, and when it attains the desired value, the key is released and the display reverts automatically to the time-of-day aspect.

But where the reading to be altered is "minutes", which reading is the last to appear in the setting cycle, the arrangement for the mode selector in the LCD display watch is such that when the "minutes" reading advances to attain the desired value and the key is then released, the display does not revert to the "time-of-day" aspect but acts to hold the "minutes" setting until the key is again pressed, at which point the display reverts to the time-of-day aspect.

The reason for holding the minutes setting rather than permitting the display to revert to the time-of-day aspect is that this holding action facilitates the precise restarting of the watch in response to a tone or other timing signal from an external reference source. This external reference source may be time signals conveyed by telephone, radio time signals or WWV transmitted standard time indications.

For instance, should one use the telephone to obtain time signals for setting the watch, and the telephone operator announces that when the next tone is heard the time will be exactly 10:30 AM, then by operating the watch in the setting mode to hold the minutes setting at "30" (it is assumed that the hour is set at 10), and pressing the key the instant the telephone tone is heard, the watch is caused to restart precisely at 10:30 in step with the telephone signal.

Since the mode selector in the setting mode causes the readings to sequence in a "day-date-month-hour-minute" cycle and since each of these readings, save for the day in the week, is in numerical form, the user upon seeing a succession of numbers may become confused as to the relationship between each number and the time information represented thereby. For example, the user seeing say a "12" may not remember whether this number in the sequence expresses the hour or the month. But inasmuch as the six digit LCD display includes two alpha-numeric digits $S_5$ and $S_6$, it becomes possible to identify each of the numerical readings in the sequence thereof and thereby avoid confusion.

Thus as shown in FIG. 4B, when in the setting mode, the "day" reading is presented in alpha terms (TU), this is self-identifying. But when the "date" reading is exhibited numerically, as in FIG. 4C where the date is given as "21" by the second set of digits $S_3$ and $S_4$, then identification is helpful. This is accomplished in the mode selector which activates the alpha-numeric digits $S_5$ and $S_6$ to identify the number as "CA", meaning the calendar date.

And when the "month" reading is presented numerically as in FIG. 4D which gives the month as "10", the last two digits then identify this reading in alpha terms as "MO". Similarly as shown in FIG. 4E, the numerical "hour" reading "8" is identified as "PM" (or "AM"). The "minutes reading (52) in FIG. 4F is identified as "MI". Thus each numerical reading in the sequence is accompanied by an approximate alpha designation.

It will be appreciated that with the addition of other features and more complicated circuits, such as memory units and various types of sensors, the mode selector and display actuator concept disclosed herein may be applied to facilitate the acquisition and display of additional information. It may be used, for example, to present barometric, tidal, astrological, menstrual and diverse forms of data as well as time information. The minicomputer incorporated in the solid-state watch may be more fully exploited in conjunction with insertable programming or memory IC chips. With a six digit electro-optic display in which all digits have an alpha-numeric capability, it becomes possible to selectively present a multiplicity of intelligence aspects on the same display. This is accomplished by means of a single key as long as the dot-dash or other code used for this purpose contains an adequate number of distinct signals.

While there has been shown and described preferred embodiments in accordance with the invention, it will be appreciated that many changes and modifications may be made therein without, however, departing from the essential spirit thereof.

We claim:

1. In a solid-state timepiece wherein timing pulses are applied to an electro-optic display through an electronic actuator having switching means for selectively energizing the display to present in an aspect mode various aspects of time information, each reading of which is settable by means of roll-over pulses serving to advance the reading at a rapid rate; apparatus for effecting selection in the aspect mode or for rendering the display operative in the setting mode, said apparatus comprising:

(A) a manually-operated switching key which may be closed and thereafter released to produce code signals which depend on the length of time the key is closed and the number of key actions, and (B) a mode selector operatively coupled to the switching means of said actuator and responsive to said code signals, said selector having logic means to decode said signals to produce respective command signals for effecting selective presentation of said aspects or for rendering said display operative in the setting mode.

2. Apparatus as set forth in claim 1, wherein said aspects include a time-of-day reading of hours and minutes, a reading of seconds and a reading of the calendar month, the code produced by the key including a distinct signal for each of said aspects as well as a signal for the setting mode.

3. Apparatus as set forth in claim 2, wherein said logic means in the setting mode operates in response to the related code signal to cause said display to step sequentially from reading-to-reading, and wherein in response to a closure of said key holds the reading then in effect which is then advanced by said roll-over pulses.

4. Apparatus as set forth in claim 2, wherein said mode selector includes a timer responsive to the key action to determine how long the key is closed.

5. Apparatus as set forth in claim 4, wherein the mode selector includes a first counter responsive to the key action to determine how many times the key has been closed, and a second counter to determine how many times the key has been released.

6. Apparatus as set forth in claim 4, wherein said timer is adapted to determine whether the period in which the key is closed is shorter than a predetermined interval and thereby defines a code dot, or is longer than said interval and thereby defines a code dash.

7. Apparatus as set forth in claim 6, wherein said mode selector in response to a single dot produces a command signal to activate said time-of-day display.

8. Apparatus as set forth in claim 7, wherein said mode selector in response to a closure first produces a command signal to activate said time-of-day display and wherein when said closure is maintained to define a dash then produces a command signal to activate said seconds display.

9. Apparatus as set forth in claim 4, wherein said timing pulses are derived from a frequency divider coupled to a high-frequency time base, and said timer is responsive to clock pulses derived from said frequency divider.

10. A timepiece as set forth in claim 1, wherein said display is a multi-digit light-emitting diode display.

11. A timepiece as set forth in claim 1, wherein said display is a multi-digit liquid crystal display.

12. In a solid-state timepiece wherein timing pulses are applied to an electro-optic digital display through an electronic actuator in which the timing pulses are converted into binary values which are decoded to produce signals to activate the display, said actuator including first electronic switching means for selectively energizing the display to provide various aspects of time information, including a reading of hours, a reading of minutes, a reading of the calendar month and a reading of the calendar date, said actuator also including second electronic switching means for applying roll-over pulses to said display for advancing and setting any one of said readings; apparatus for operating said timepiece in the setting mode comprising a key-operated mode selector associated with said actuator and having logic means responsive to a first signal from the key to cause said first switching means to undergo a stepping action in which said readings are successively presented, said mode selector being responsive to a second signal from the key to hold the reading then in effect and to cause said second switching means to operate to apply roll-over pulses to the selected reading.

13. In a timepiece as set forth in claim 12, wherein with respect to one of said readings, when the key is released to arrest said roll-over pulses, the reading then in effect is held until the key is again operated.

14. In a timepiece as set forth in claim 12, wherein said display is a six digit liquid crystal display whose first four digits are adapted to present numeric data and whose two last two digits are adapted to present alphanumeric data, said display having a first normally-on aspect in which the first two digits numerically present the hour, the second two digits numerically present the minutes and the last two digits numerically present the seconds, and a second normally-off aspect which is turned on by a code operation of said key, in which second aspect the first two digits numerically present the month, the second two digits numerically present the date and the last two digits in alpha terms present the day of the week.

15. In a timepiece as set forth in claim 14, wherein each sequentially presented numerical reading is presented by the first two or the second two digits and is accompanied by an identification thereof in alpha form in the last two digits.

16. In a timepiece as set forth in claim 11, wherein a colon is interposed in the display between the first two and second two digits, and wherein said colon is continuously presented in the aspect mode of the display and is caused to flash in the setting mode thereof.

17. In a solid-state timepiece having an electro-optic display adapted to present any one of a series of readings including hours and minutes, a key-operated electronic system for setting any one of the readings to a desired value, said system comprising:

A means responsive to a first action of the key to cause the readings in the series to be presented by the display in a sequential stepping cycle in which each reading is displayed for a predetermined period before stepping to the next reading, B means responsive to a second action of the key while the cycle is in progress to hold the reading then in effect and to cause said reading to advance at a relatively rapid rate, and C means responsive to a third action of the key to stop any further advance of the held reading when it attains the desired value.

18. In a solid state timepiece provided with a multi-digit, electro-optic digital display and electronic means generating pulses to activate the digits of said display, the combination of an electronic display actuator responsive to said pulses and including electronic switching means for selectively energizing the digits of said display to present different aspects of information, a single manually-operated switching key which may be successively closed and released to produce distinctive code signals, each of which depends on the duration of and the number of key actions, and logic means responsive to said code signals and coupled to the electronic switching means of said display actuator, said logic means decoding said signals to produce respective command signals which are applied to said electronic switching means to selectively effect the presentation of the different aspects of information, whereby by manually operating said key to produce a distinctive code signal, a selected one of said aspects is presented by the display.

19. An electronic timepiece comprising:

an electrooptical display means having a plurality of indicia thereon for separately indicating different time intervals;

a timekeeping circuit means coupled to said display means for actuating each indicia to visually display time information;

a manually operated switch having a single manually operated actuator; and circuit means operated by said switch and coupled to the timekeeping circuit means and to the display indicia for effecting sequential and separate distinction of the indicia and for effecting separate and selective adjustment of the time information being displayed thereby by the single manually operated actuator being manually operated in a prescribed manner.

* * * * *